US008375505B2

(12) United States Patent
Hsiau et al.

(10) Patent No.: US 8,375,505 B2
(45) Date of Patent: Feb. 19, 2013

(54) APPARATUS ERASING BLACKBOARD THROUGH AREAS

(75) Inventors: Shu-San Hsiau, Taoyuan County (TW); Chi-Hsin Ho, Taoyuan County (TW); Peng-Shin Lee, Taoyuan County (TW); Po-Ting Pan, Taoyuan County (TW); Chao-Hung Zeng, Taoyuan County (TW); Yi-Fu Hsieh, Taoyuan County (TW)

(73) Assignee: National Central University, Taoyuan (TW)

( * ) Notice: Subject to any disclaimer, the term of this patent is extended or adjusted under 35 U.S.C. 154(b) by 625 days.

(21) Appl. No.: 12/683,946

(22) Filed: Jan. 7, 2010

(65) Prior Publication Data

US 2011/0162163 A1 Jul. 7, 2011

(51) Int. Cl.
*A47L 5/00* (2006.01)

(52) U.S. Cl. ..... 15/312.1; 15/3.53; 15/301

(58) Field of Classification Search ..... 15/3.53, 15/301, 312.1
See application file for complete search history.

(56) References Cited

U.S. PATENT DOCUMENTS 1,801,620 A * 4/1931 Bettman ..... 15/344
6,266,841 B1 * 7/2001 Cho ..... 15/246
6,370,720 B1 * 4/2002 Jang ..... 15/98

* cited by examiner

*Primary Examiner* — Lee D Wilson
*Assistant Examiner* — Shantese McDonald
(74) *Attorney, Agent, or Firm* — Jackson IPG PLLC

(57) ABSTRACT

The present invention wipes a writing board through areas. A teacher can wipe an area of a blackboard while writing on another area. Thus, a writing board can be flexibly used with convenience obtained and time saved.

8 Claims, 3 Drawing Sheets

APPARATUS ERASING BLACKBOARD THROUGH AREAS

FIELD OF THE INVENTION

The present invention relates to erasing a writing board; more particularly, relates to freely selecting an area of a writing board for wiping even when writing on another area at the same time with flexibility and humanization obtained and time saved.

DESCRIPTION OF THE RELATED ART

A blackboard erasing device usually wipes a blackboard wholly. As shown in FIG. 3, a prior art has an eraser 31 contacting a blackboard 30; the eraser 31 is connected with a motor seat 33 at an upper end of the eraser 31 through a cantilever support 32; and a track 34 is set at an upper side of the blackboard 30. Thus, a rubber wheel 36 is moved by a motor 36 to carry the eraser 31 by the motor seat 33 and the cantilever support 32 for sliding rightward and leftward along the whole track 34, where the eraser 31 has the same height as the blackboard 30 for wiping the whole blackboard 30. However, when a blackboard writer wants to erase a part of writing on the blackboard 30 but still wants to write on another part of the blackboard 30, such a prior art is apparently unavailable. If the writer really wants to do the above operation, he may have to wipe off the blackboard manually. This may take time and is so inconvenient. Hence, the prior art does not fulfill all users' requests on actual use.

SUMMARY OF THE INVENTION

The main purpose of the present invention is to freely select an area of a writing board for wiping even when writing on another area at the same time with flexibility and humanization obtained and time saved.

Another purpose of the present invention is to further design position sensors to change sizes of the areas of the writing board; and to divide the writing board into board areas horizontally or vertically; or even divided into grids of board areas horizontally and vertically.

To achieve the above purposes, the present invention is an apparatus erasing blackboard having areas, comprising a writing board, a plurality of gears, a belt, a plurality of position sensors, a slider, an expansion part, an erasing part and a suction part, where the writing board is divided into a plurality of board areas; the gears are located at two sides on top of the writing board and have a track set between the two sides; the belt circles the gears; the position sensors are set on the track and are electrically connected with a border of the board areas; the slider is assembled on the track and is moved by the belt driven by the motor to slide along the track toward a designated one of the board areas; the expansion part comprises a first expansion cylinder and a second expansion cylinder and is connected with an end surface of the slider; the erasing part connects to the second expansion cylinder and stays close to a surface of the writing board; and the suction part connects around the erasing part to suck dust obtained on wiping off writing on the designated board area; and the apparatus has an automatic control system remotely controlled by a control panel. Accordingly, a novel apparatus erasing blackboard having areas is obtained.

BRIEF DESCRIPTION OF THE DRAWINGS

The present invention will be better understood from the following detailed description of the preferred embodiment according to the present invention, taken in conjunction with the accompanying drawings, in which.

DESCRIPTION OF THE PREFERRED EMBODIMENT

The following description of the preferred embodiment is provided to understand the features and the structures of the present invention.

Figure 1:
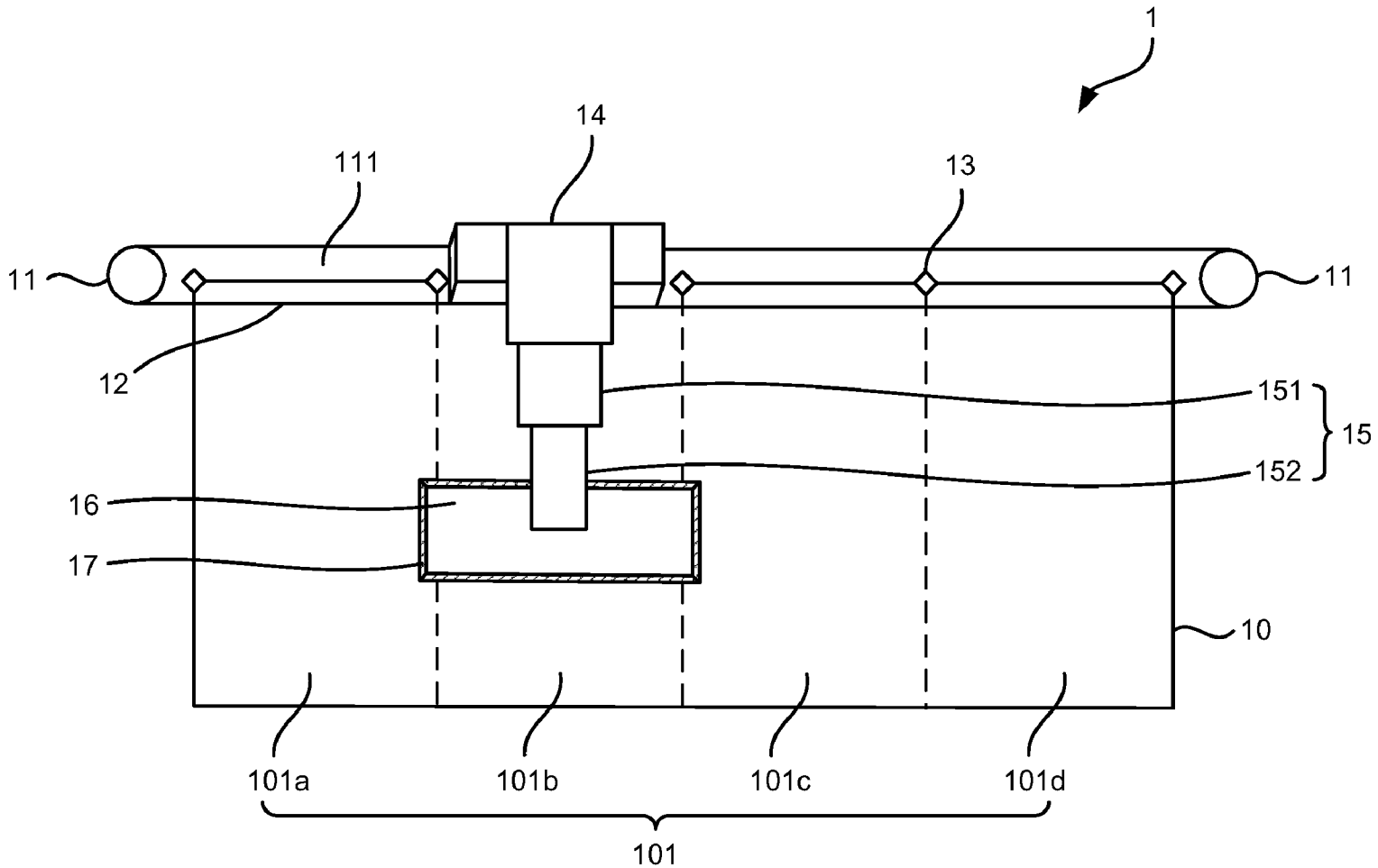
FIG. 1 is the structural view showing the preferred embodiment according to the present invention.
Figure 2:
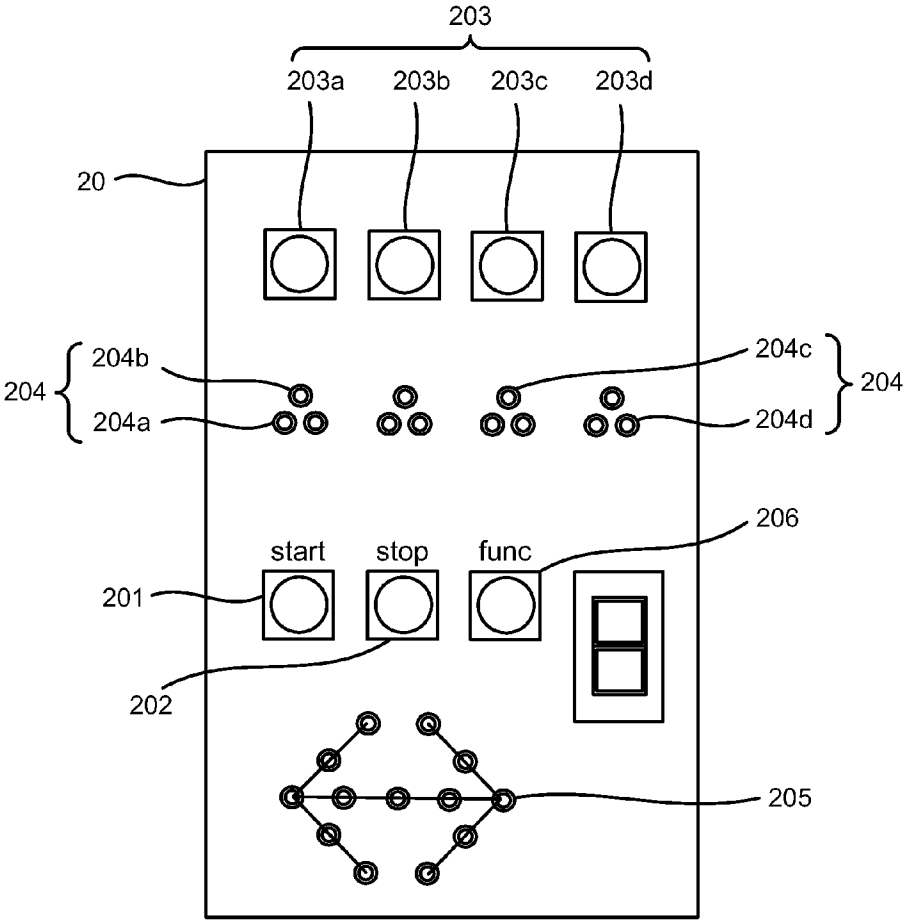
FIG. 2 is the view showing the control panel.
Figure 3:
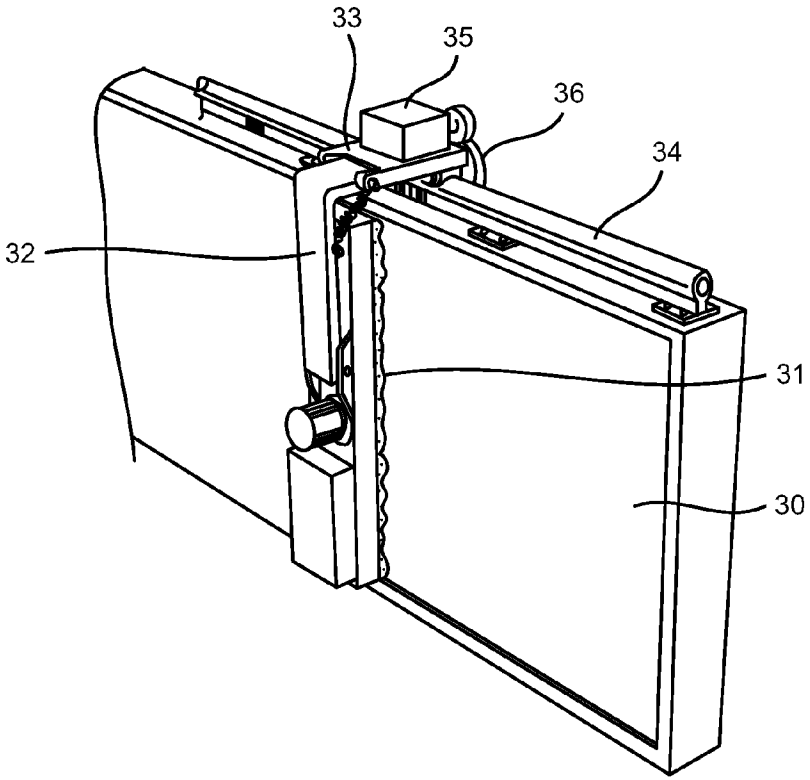
FIG. 3 (prior art)
FIG. 3 is the view of the prior art.

Please refer to FIG. 1 and FIG. 2, which are a structural view showing a preferred embodiment according to the present invention and a view showing a control panel. As shown in the figures, the present invention is an apparatus erasing blackboard having areas 1, comprising a writing board 10, a plurality of gears 11, a belt 12, a plurality of position sensors 13, a slider 14, an expansion part 15, an erasing part 16 and a suction part 17, where the writing board 10 is divided into a plurality of board areas 101; and the apparatus 1 has an automatic control system remotely controlled by a control panel 20.

The gears 11 are located at two sides on top of the writing board and have a track 111 set between the two sides.

The belt 12 circles the gears 11.

The position sensors 13 are set on the track 111 and are electrically connected with a border of the board areas 101. The position sensor 13 senses a position trigger signal at the border of the board areas 101 and sends a feedback signal to an 8051 single chip according to the position trigger signal to drive a motor. Therein, the position sensor 13 comprises a signal receiver set on the track 111, such as a photoresistor; and a signal emitter set at the border of the board areas 101, such as a light emitting diode (LED).

The slider 14 is assembled on the track 111 and is driven by the motor to be rotated to carry the slider 14 by the belt 12 for sliding along the track 111 to be moved to a designated one of the board areas 101.

The expansion part 15 comprises a first expansion cylinder and a second expansion cylinder to be expanded at two ranges. The expansion part 15 connects to an end surface of the slider 14 at an end of the expansion part 15; and is expanded from the end surface of the slider 14 perpendicularly in correspondence to the designated one of the board areas 101.

The erasing part 16 connects to the second expansion cylinder of the expansion part 16, where the erasing part 16 stays close to a surface of the writing board to wipe off writing on the designated one of the board areas 101.

The suction part 17 connects around the erasing part 16 to suck dust obtained on wiping off writing on the designated one of the board areas 101. Thus, with the above structure, a novel apparatus erasing blackboard having areas is obtained.

The control panel 20 comprises a start bottom 201 signally connected with the 8051 single chip; a stop bottom 202 signally connected with the motor; a plurality of press bottoms 203 signally connected with the board areas 101; a plurality of area indicators 204 corresponding to the press bottoms 203 and signally connected with the board areas 101; a plurality of direction indicators 205 signally connected with the slider 14; and a function bottom 206 signally connected with the erasing part 16, where the apparatus 1 is started by the control panel 20 with operations controlled and monitored.

The writing board 10 is divided into a plurality of board areas 101*a*~101*d*. Programs are designed in the 8051 single chip. A position signal is fed back by one of the position sensors 13; then positioning is done with the coordination of the LED and the photoresistor of the position sensor 13.

On using the present invention, one of the board areas 101*a*~101*d* is selected and the press bottom 203*a*~203*d* corresponding to the designated board area 101*a*~101*d* is pressed down. The area indicator 204*a*~204*d* corresponding to the press bottom 203*a*~203*d* pressed down is turned on to show that control data are saved and confirmed. Then, the start bottom 201 on the control panel 20 is pressed down to run the apparatus 1.

When the start bottom 201 is pressed down, the 8051 single chip drives the motor to rotate the gears 11 for moving the belt 12 and further carrying the slider 14 to slide along the track 111. By sliding the slider 14 along the track 111, one of the position sensors 13 set on the border of the board areas 101*a*~101*d* is triggered to send a feedback signal of the position sensor 13 to be analyzed by the 8051 single chip for judging whether a position trigger signal sent by the position sensor 13 is received. Thus, the board areas of the writing board are functioned. Therein, a moving direction of the slider 14 is simultaneously shown by the direction indicators 205 on the control panel. When the slider 14 approaches the designated board area 101, the expansion part 15 expands its first expansion cylinder 151 and second expansion cylinder 152 to carry the erasing part 16 for wiping off writing on the writing board 10; and the suction part 17 simultaneously sucks the dust obtained on wiping off the writing on the writing board 10.

In this way, the designated board area 101 of the writing board is freely selected for wiping, even when writing o another board area 101 at the same time. More flexibility and humanization are thus obtained and time is saved.

In addition, the position sensors can be further designed to change sizes of the board areas of the writing board. Besides, the writing board can be divided into board areas horizontally or vertically; or, even divided into grids of board areas horizontally and vertically.

To sum up, the present invention is an apparatus erasing blackboard having areas, where an area of the writing board is freely selected for wiping even when writing on another area at the same time; and more flexibility and humanization are thus obtained with time saved.

The preferred embodiment herein disclosed is not intended to unnecessarily limit the scope of the invention. Therefore, simple modifications or variations belonging to the equivalent of the scope of the claims and the instructions disclosed herein for a patent are all within the scope of the present invention.

What is claimed is:

1. An apparatus erasing blackboard having electronically defined areas, comprising:

a writing board, said writing board being electronically divided into board areas horizontally;

a plurality of gears, said gears being located at two sides on a top of said writing board, said plurality of gears having a track set between said two sides; a belt, said belt circling said gears;

a plurality of position sensors, said position sensors being set on said track and electrically connecting to each border of multiple respective borders of said board areas, said position sensor sensing a position trigger signal at said border of said board area, said position sensor sending a feedback signal to a single chip according to said position trigger signal to drive a motor;

a slider, said slider being assembled on said track, said gears being driven by said motor to be rotated to carry said slider by said belt to slide along said track to be moved to a designated one of said board areas;

an expansion part, said expansion part comprising a first expansion cylinder and a second expansion cylinder to be expanded at two ranges, said expansion part connecting to an end surface of said slider at an end of said expansion part, said expansion part being expanded from said end surface of said slider perpendicularly in correspondence to said designated one of said board areas;

an erasing part, said erasing part connecting to said second expansion cylinder of said expansion part, said erasing part staying close to a surface of said writing board to wipe off writing on said designated one of said board areas; and a suction part, said suction part connecting around said erasing part to suck dust obtained on wiping off writing on said designated one of said board areas, wherein said apparatus has an automatic control system remotely controlled by a control panel.

2. The apparatus according to claim 1, wherein said writing board electronically is divided into board areas vertically.

3. The apparatus according to claim 1, wherein said writing board is electronically divided into grids of board areas vertically and horizontally.

4. The apparatus according to claim 1, wherein positions of said position sensors are changeable to change sizes of said board areas.

5. The apparatus according to claim 1, wherein said position sensor comprises a signal receiver set on said track; and a signal emitter set at said border of said board areas.

6. The apparatus according to claim 5, wherein said signal receiver is a photoresistor.

7. The apparatus according to claim 5, wherein said signal emitter is a light emitting diode (LED).

8. The apparatus according to claim 1, wherein said control panel comprises a start bottom, a stop bottom, a plurality of press bottoms, a plurality of area indicators, a plurality of direction indicators and a function bottom.

* * * * *